US006712242B2

(12) United States Patent
Friedman

(10) Patent No.: US 6,712,242 B2
(45) Date of Patent: Mar. 30, 2004

(54) FLUID DISPENSING SYSTEM AND DUAL-MODE, SYSTEM FLUID ACTUATED VALVE FOR USE THEREIN

(75) Inventor: Mitchell A. Friedman, Randallstown, MD (US)

(73) Assignee: International Dispensing Corporation, Hanover, MD (US)

( * ) Notice: Subject to any disclaimer, the term of this patent is extended or adjusted under 35 U.S.C. 154(b) by 215 days.

(21) Appl. No.: 10/044,003

(22) Filed: Oct. 26, 2001

(65) Prior Publication Data

US 2002/0170925 A1 Nov. 21, 2002

Related U.S. Application Data

(60) Provisional application No. 60/243,510, filed on Oct. 26, 2000.

(51) Int. Cl.[7] ..... B67D 5/56

(52) U.S. Cl. ..... 222/129.2; 222/145.1; 137/109

(58) Field of Search ..... 137/109, 111, 137/893; 251/61.4, 31; 222/129.1, 129.2, 145.1, 145.5, 145.6

(56) References Cited

U.S. PATENT DOCUMENTS

| | | | | |
|---|---|---|---|---|
| 587,150 | A | | 7/1897 | De Leval |
| 773,730 | A | | 11/1904 | Gertiz |
| 775,250 | A | | 11/1904 | Robinson |
| 813,577 | A | | 2/1906 | Oakman |
| 891,808 | A | | 6/1908 | Adams |
| 981,313 | A | | 1/1911 | Robinson |
| 1,023,187 | A | | 4/1912 | White |
| 1,077,795 | A | | 11/1913 | Bruns |
| 1,224,221 | A | | 5/1917 | Schwanebeck |
| 1,319,404 | A | | 10/1919 | McGuire et al. |
| 1,334,612 | A | | 3/1920 | Irving |
| 1,406,026 | A | | 2/1922 | Jensenius |
| 1,548,098 | A | | 8/1925 | Raymond |
| 1,743,620 | A | | 1/1930 | Quiroz et al. |
| 1,753,662 | A | * | 4/1930 | Merker ..... 137/111 |
| 2,783,020 | A | | 2/1957 | Kleczek |
| 2,811,958 | A | | 11/1957 | Roush, Jr. |
| 3,042,077 | A | | 7/1962 | Waddington et al. |
| 3,120,221 | A | | 2/1964 | Lyons |
| 3,257,180 | A | | 6/1966 | King |
| 3,623,509 | A | | 11/1971 | Sesseler et al. |
| 3,631,888 | A | | 1/1972 | Anton et al. |
| 3,817,264 | A | * | 6/1974 | Kilayko ..... 137/111 |
| 4,023,355 | A | | 5/1977 | McDonald |
| 4,031,915 | A | | 6/1977 | McElhoe et al. |
| 4,044,834 | A | | 8/1977 | Perkins |
| 4,076,210 | A | | 2/1978 | Spielvogel |
| 4,172,582 | A | | 10/1979 | Bobnar |
| 4,281,678 | A | | 8/1981 | Claycomb |

(List continued on next page.)

*Primary Examiner*—Kenneth Bomberg
(74) *Attorney, Agent, or Firm*—Whiteford, Taylor & Preston LLP; Gregory M. Stone; Jeffrey C. Maynard

(57) ABSTRACT

Disclosed is a fluid dispensing system for precisely controlling the mixing of a first fluid (i.e., a diluent such as water) with a second fluid (i.e., a concentrate) at a mixing point within the fluid dispensing system. A valve is positioned in the dispensing system along the line of supply of the second fluid upstream of the mixing point, such valve being simultaneously actuated through application of positive and/or negative pressure to allow the second fluid to flow through the valve. The application of positive and/or negative pressure is generated from the first fluid to be dispensed by the system and mixed with the second, such that the termination of flow of the first fluid immediately terminates flow of the second fluid to ensure proper mixing of the two fluids in the final solution, thus preventing inadvertent leakage of the second fluid or collection of the second fluid within the flow system which may become subject to spoilage or contamination.

27 Claims, 5 Drawing Sheets

U.S. PATENT DOCUMENTS

| | | | |
|---|---|---|---|
| 4,311,160 | A | 1/1982 | Charland |
| 4,694,730 | A | 9/1987 | Krieger et al. |
| 4,712,576 | A | 12/1987 | Ariizumi et al. |
| 4,750,645 | A | 6/1988 | Wilson et al. |
| 4,828,219 | A | 5/1989 | Ohmi et al. |
| 4,860,788 | A | 8/1989 | Asaoka |
| 4,921,215 | A | 5/1990 | Fujiwara |
| 5,241,986 | A | 9/1993 | Yie |
| 5,253,671 | A | 10/1993 | Kolenc |
| 5,295,508 | A | 3/1994 | Reisinger |
| 5,368,195 | A | 11/1994 | Pleet et al. |
| 5,653,251 | A | 8/1997 | Handler |
| 5,762,316 | A | 6/1998 | Barnett |

* cited by examiner

FLUID DISPENSING SYSTEM AND DUAL-MODE, SYSTEM FLUID ACTUATED VALVE FOR USE THEREIN

CROSS REFERENCE TO RELATED APPLICATIONS

The present application is based upon and gains priority from U.S. Provisional Patent Application Serial No. 60/243,510, filed Oct. 26, 2000 by the inventor herein and entitled "Beverage Dispensing System and Dual-Mode, System Fluid Actuated Valve for Use Therein," the specification of which is incorporated herein by reference.

BACKGROUND OF THE INVENTION

1. Field of the Invention

The invention disclosed herein relates generally to fluid dispensing systems, and more particularly to a fluid dispensing system for controlling the mixing of a first fluid (i.e., a diluent such as water) with a second fluid comprising a food concentrate (e.g., sauces), a non-carbonated beverage concentrate (e.g., juice or isotonic drink concentrate), or a non-food concentrate (e.g., solvents such as windshield wiper fluids or cleaning fluids) and the like, at a mixing point within the fluid dispensing system. The system comprises a valve positioned in the dispensing system along the line of supply of the second fluid upstream of the mixing point, such valve being simultaneously actuated through application of positive and/or negative pressure to allow the second fluid to flow through the valve. Such positive and/or negative pressure is generated from the first fluid to be dispensed by the system and mixed with the second, such that the termination of flow of the first fluid immediately terminates flow of the second fluid to ensure precise mixing of the two fluids in the final solution and to prevent inadvertent leakage of the second fluid.

2. Description of the Background

Fluid dispensers have long been used in numerous food service locales, including retail restaurants, juice bars, hospitals, nursing homes, schools, and the like. Such fluid dispensers often require the mixing of diluents, such as, water and a flavoring agent (such as a soft drink flavoring syrup or juice, dairy, or isotonic concentrate), into a final product having a precise water to concentrate ratio to provide the consumer with the desired taste of the final product. In order to maximize the appeal of the product to the consumer, and thus obtain continuous customers and sales, it is critical that the ratio of water to concentrate be maintained at a precise level and mixed thoroughly, and that the system maintain a FDA prescribed level of sterility.

In the case of traditional dispensing systems, when dispensing soft drinks, the flavoring agent ordinarily comprises a generally tacky syrup of relatively low viscosity. However, when dispensing noncarbonated drinks, such as juices, dairy beverages, and isotonic drinks, the flavoring agent ordinarily comprises a concentrate which comprises a highly viscous fluid that presents greater difficulty in flow regulation than traditional flavoring syrups. Positive displacement pumps, such as peristaltic pumps, are often used to regulate the flow of such beverage concentrate dispensing systems. However, systems using pumps require that a large physical space be devoted to housing the pumping apparatus. Further, such systems are prone to leaking or clogging after repeated daily use. Moreover, commercial grade, less expensive pumps used in dispensing peristaltic pumps have also been found to provide imprecise dispensing of small volumes of liquid as would be dispensed, for example, for a 12 oz. juice drink.

Moreover, such fixed ratio pumps tend to pass a "slug" of water or other driving fluid at the reversal on each half cycle of the pump, resulting in stratification or non-uniformity of the dispensed beverage. Such pumps are also prone to dispensing a bit of afterflow concentrate as the pump terminates operation at the end of the dispensing cycle, thus either inadvertently dispensing a slug of pure concentrate into the drink at the end of the cycle, or positioning a slug of pure, unmixed concentrate to be delivered to the cup prior to the water/concentrate mixture at the start of the next dispensing cycle, in turn dispensing beverages of highly variable quality. The existing juice dispensers using peristaltic pumps are not a self-flushing system and require disassembly to be cleaned.

Even outside the field of beverage dispensing systems, the problems mentioned above plague dispensing systems that attempt to dispense measure quantities of any fluid comprised of a viscous concentrate and a diluent, such as cleaning or other industrial fluids.

Thus, there is a need in the art for a fluid dispensing system which is capable of thoroughly and precisely mixing and dispensing fluids formed from a concentrate and a diluent, such fluids being of uniform ratio even for small volumes of dispensed fluids, which system avoids the problems associated with traditional fluid dispensing systems that utilize positive displacement pumps, which is more compact than traditional fluid dispensing systems, and which is effective in operation despite the inherent characteristics and anomalies of viscous concentrates. There is also a need for a system that offers a self-cleaning rinse mechanism after each use to insure the fluids are kept commercially sterile.

SUMMARY OF THE INVENTION

It is, therefore, an object of the present invention to provide a fluid dispensing system which avoids the disadvantages of the prior art.

It is another object of the present invention to provide a fluid dispensing system which can provide a uniform ratio of diluent to concentrate for each dispensed dose and maintain commercial sterility levels through a self-cleaning process. Either hot water and/or hot water in conjunction with an FDA approved hydrogen peroxide solution can be automatically attached to flush the lines of the system.

It is yet another object of the present invention to provide a fluid dispensing system which is actuated to dispense a first fluid via pressure applied by a second dispensed fluid.

It is still yet another object of the present invention to provide a fluid dispensing system having a dual-mode, system fluid actuated flow valve which is simultaneously and selectively actuated through the application of both positive and negative pressure forces in a complimentary fashion.

It is even yet another object of the present invention to provide a fluid dispensing system which immediately terminates the flow of concentrate upon the termination of flow of diluent so as to prevent the dispensing of an afterflow slug of concentrate at the end of the dispensing cycle or leakage of flavoring concentrate into the dispensing flow line or to allow bacteria to migrate back into the concentrate package.

It is even yet another object of the present invention to provide a fluid dispensing system which provides a dispensed fluid that is thoroughly and precisely mixed and blended even in small batches.

It is still even yet another object of the present invention to provide a fluid dispensing system which ensures the maintenance of a sterile environment for all non-dispensed portions of concentrate.

In accordance with the above objects, a fluid dispensing system is disclosed which enables the consistent, uniform dispensing and mixing of a desired ratio of concentrate to diluent, even for small volumes of dispensed fluids. The system of the present invention includes a valve positioned between the source of the concentrate and the point at which the concentrate is introduced to the diluent, the valve comprising a valve body having a first chamber, hereafter indicated as the "flow chamber," and a second chamber, hereafter indicated as the "actuation chamber," the flow chamber and the actuation chamber being separated by an intermediate wall within the valve body, and a plunger configured for reciprocal movement within the flow chamber and actuation chamber. A first end of the plunger comprises a valve head configured to seat against a valve seat wall in the flow chamber. When seated against the valve seat wall, the valve head prevents the flow of fluid through the flow chamber from a fluid inlet positioned on a first side of the valve head to a fluid outlet positioned on the opposite side of the valve head. A second end of the plunger comprises a piston head which is resiliently biased towards an end wall of the actuation chamber by a resilient member, and which in turn resiliently biases the valve head against the valve seat in the flow chamber. A flexible diaphragm is positioned between the piston head and the end wall of the actuation chamber, and separates the actuation chamber into a positive pressure actuation zone (the space between the diaphragm and the end wall of the actuation chamber) and a negative pressure actuation zone (the space between the diaphragm and the intermediate wall of the valve body). The end wall of the actuation chamber is provided with two ports, namely, a fluid inlet and outlet port for supplying fluid to and removing fluid from the positive pressure actuation zone. Likewise, the side wall of the actuation chamber is provided with one port, namely, a vacuum port for supplying a vacuum to the negative pressure actuation zone.

In operation, fluid applied to the inlet port of the positive pressure actuation zone, as well as vacuum applied to the vacuum port of the negative pressure actuation zone, each tend to compress the piston head against the resilient member, in turn moving the valve head in the flow chamber away from the valve seat to enable flow through the flow chamber.

The resilient member is so configured as to firmly hold the valve closed when diluent is not flowing, thus preventing the inadvertent leakage of concentrate into the flow system downstream of the valve. By closing the valve at the instant that diluent fluid flow is terminated, concentrate has no opportunity to leak into or come to rest within the flow system downstream of the valve, such that the entire volume of undispensed fluid is kept isolated from potential contaminants (e.g., bacteria) outside of the dispensing system.

In a preferred embodiment of the present invention, the valve is employed in a fluid control system for dispensing a first fluid that is to be mixed with a second fluid. In such embodiment, the first fluid to be dispensed (and mixed with the second) serves as both (1) the fluid applied to the positive pressure actuation zone, and (2) the fluid whose flow generates a vacuum to be applied to the negative pressure actuation zone, while the second fluid to be dispensed is that which flows through the flow chamber when the valve is actuated. In order to generate a vacuum to be applied to the negative pressure actuation zone of the valve, as well as to generate a vacuum to draw the second fluid (e.g., concentrate) from its storage vessel and into the stream of the first fluid (e.g., diluent), the fluid dispensing system of the present invention utilizes a venturi or ejector "pump" to generate the required vacuum. In a preferred embodiment of the fluid dispensing system of the present invention, a diluent supply source is configured to simultaneously and selectively direct diluent (e.g., water) to the fluid inlet port of the positive pressure actuation zone of the valve, and through a venturi positioned downstream of the valve. The flow of diluent through the venturi generates vacuum forces which (i) draw the concentrate from its container when the valve is open; (ii) supply vacuum to the negative pressure actuation zone of the valve; and (iii) withdraw diluent supplied to the positive pressure actuation zone of the valve.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
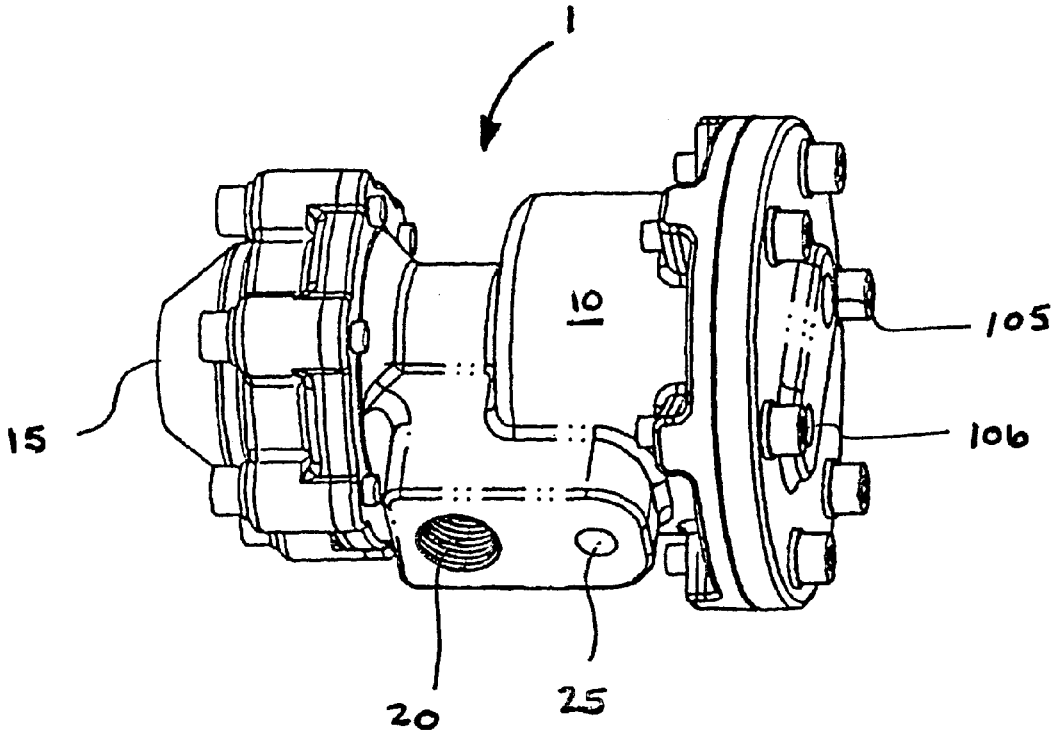
FIG. 1 is a perspective view of the dual-mode actuated valve for use in the fluid dispensing system of the present invention.
Figure 2:
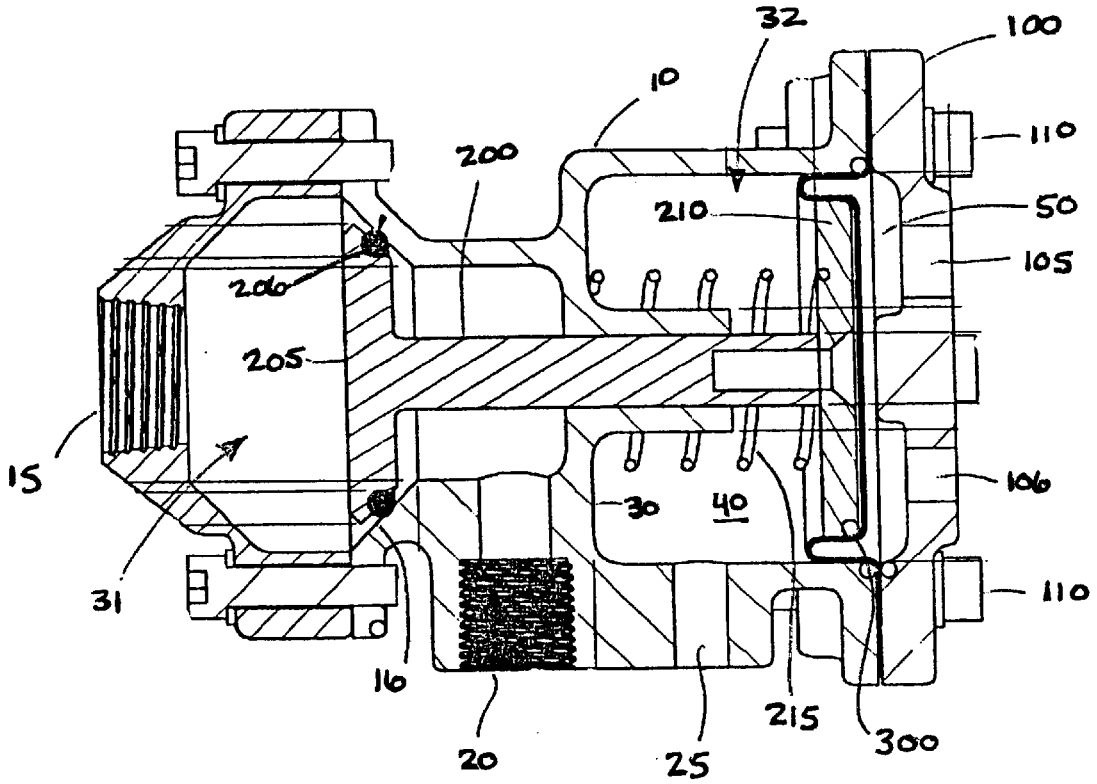
FIG. 2 is a side, sectional view of the valve of FIG. 1.

As shown in the perspective view and side, sectional view of FIGS. 1 and 2, respectively, the dual-mode, system fluid actuated valve for use in the fluid dispensing system of the present invention comprises a flow control valve which may be actuated either through application of a vacuum force generated by the flow of a dispensed liquid, or application of positive pressure forces generated by such dispensed liquid, or the simultaneous application of both vacuum and positive pressure forces from such dispensed liquid, to dispense a second dispensed fluid which is to be mixed with the first. The valve comprises a generally elongate valve body 10 having a fluid inlet port 15 positioned within an end wall of the valve body, a fluid outlet port 20 positioned within a side wall of the valve body, and a vacuum port 25 positioned within a side wall of the valve body. An intermediate wall 30 is positioned within valve body 10 in such a position as to separate the valve body into two chambers, namely, a flow chamber (shown generally at 31), and an actuation chamber (shown generally at 32), such that inlet port 15 and outlet port 20 provide fluid communication between the exterior of the valve body and the flow chamber, while vacuum port 25 provides fluid communication between the exterior of the valve body and the actuation chamber.

The end of actuation chamber 32 opposite intermediate wall 30 is capped with an end plate 100, which is preferably attached to valve body 10 via a plurality of threaded members 110. End plate 100 is configured with two openings, namely, an inlet port 105 and an outlet port 106, such that when end plate 100 is affixed to valve body 10, inlet and outlet ports 105 and 106 likewise provide fluid communication between the interior of the actuation chamber and the exterior of the valve body.

Positioned within valve body 10 and extending through intermediate wall 30 is a valve plunger 200. Mounted at a first end of valve plunger 200 is a valve head 205 configured to seat against a valve seat 16 defined by the angled side wall of flow chamber 31. Preferably, an O-ring, gasket, or other flexible sealing means 206 is positioned between valve head 205 and valve seat 16 when the valve is in the closed position to ensure a tight seal and no inadvertent leakage of fluid through the valve structure. Mounted at the second end of valve plunger 200 is a piston head 210. A resilient member 215, such as a coil spring, is juxtaposed between intermediate wall 30 and piston head 210 to always bias piston head 210 towards end plate 100. Because plunger 200, valve head 205, and piston head 210 are a unitary structure, the biasing of piston head 210 towards end plate 100 likewise biases valve head 205 towards valve seat 16 in flow chamber 31, such that when no actuation forces (whether vacuum or positive pressure) are applied, the valve sits in a closed position, preventing the flow of fluid through flow chamber 31.

A flexible diaphragm 300 is provided between piston head 210 and end plate 100, and spans the entire width of actuation chamber 32, thus splitting actuation chamber 32 into two zones, namely, a vacuum or negative pressure actuation zone 40 and a positive pressure actuation zone 50. Negative pressure actuation zone 40 extends from intermediate wall 30 to the underside of diaphragm 300, while positive pressure actuation zone 50 extends from the top side of diaphragm 300 to end plate 100. Diaphragm 300 is firmly clamped at its ends between end plate 100 and valve body 10, such that negative pressure actuation zone 40 is entirely isolated from positive pressure actuation zone 50, and no fluid communication exists between those two zones.

In use, fluid concentrate is supplied to inlet port 15. Because no pressure is being applied to positive pressure actuation zone 50, and no vacuum is being applied to negative pressure actuation zone 40, resilient member 215 biases piston head 210 towards end plate 100, and thus biases valve head 205 in flow chamber 31 against valve seat 16, compressing flexible sealing means 206 and preventing flow of the fluid around valve head 205 and through outlet port 20.

When fluid is delivered to positive pressure actuation zone 50 through port 105 so as to supply a positive pressure force within zone 50, positive pressure actuation zone 50 expands, in turn driving piston head 210 away from end plate 100, compressing resilient member 215, and likewise lifting valve head 205 away from valve seat 16 in flow chamber 31. Once valve head 205 is lifted away from valve seat 16, the fluid applied through inlet port 15 is free to flow around piston head 205 and out of outlet port 20. When the supply of fluid to positive pressure actuation zone 50 is terminated, resilient member 215 immediately drives piston head 210 in the opposite direction (now towards end plate 100), in turn driving valve head 205 back towards valve seat 16 in flow chamber 31, until valve head 205 comes to rest against valve seat 16, at which point flow of the fluid is once again immediately terminated.

Likewise, when vacuum is applied to vacuum port 25 so as to apply a vacuum or negative pressure force within negative pressure actuation zone 40, zone 40 contracts, in turn pulling piston head 210 away from end plate 100, compressing resilient member 215, and likewise lifting valve head 205 away from valve seat 16 in flow chamber 31. Once valve head 205 is lifted away from valve seat 16, the fluid applied through inlet port 15 is free to flow around piston head 205 and out of outlet port 20. When the supply of vacuum to negative pressure actuation zone 40 is terminated, resilient member 215 immediately drives piston head 210 in the opposite direction (now towards end plate 100), in turn driving valve head 205 back towards valve seat 16 in flow chamber 31, until valve head 205 comes to rest against valve seat 16, at which point flow of the fluid is once again immediately terminated.

As both application of positive pressure to positive pressure actuation zone 50, and application of vacuum or negative pressure to negative pressure actuation zone 40, tend to unseat valve head 205 from valve seat 16 in flow chamber 31, it may readily be seen that the simultaneous application of both positive pressure to zone 50 and vacuum to zone 40 may enable an even faster response to initiate flow of the fluid through flow chamber 31, thus providing increased accuracy in the dispensing of desired proportions of fluids.

Figure 3:
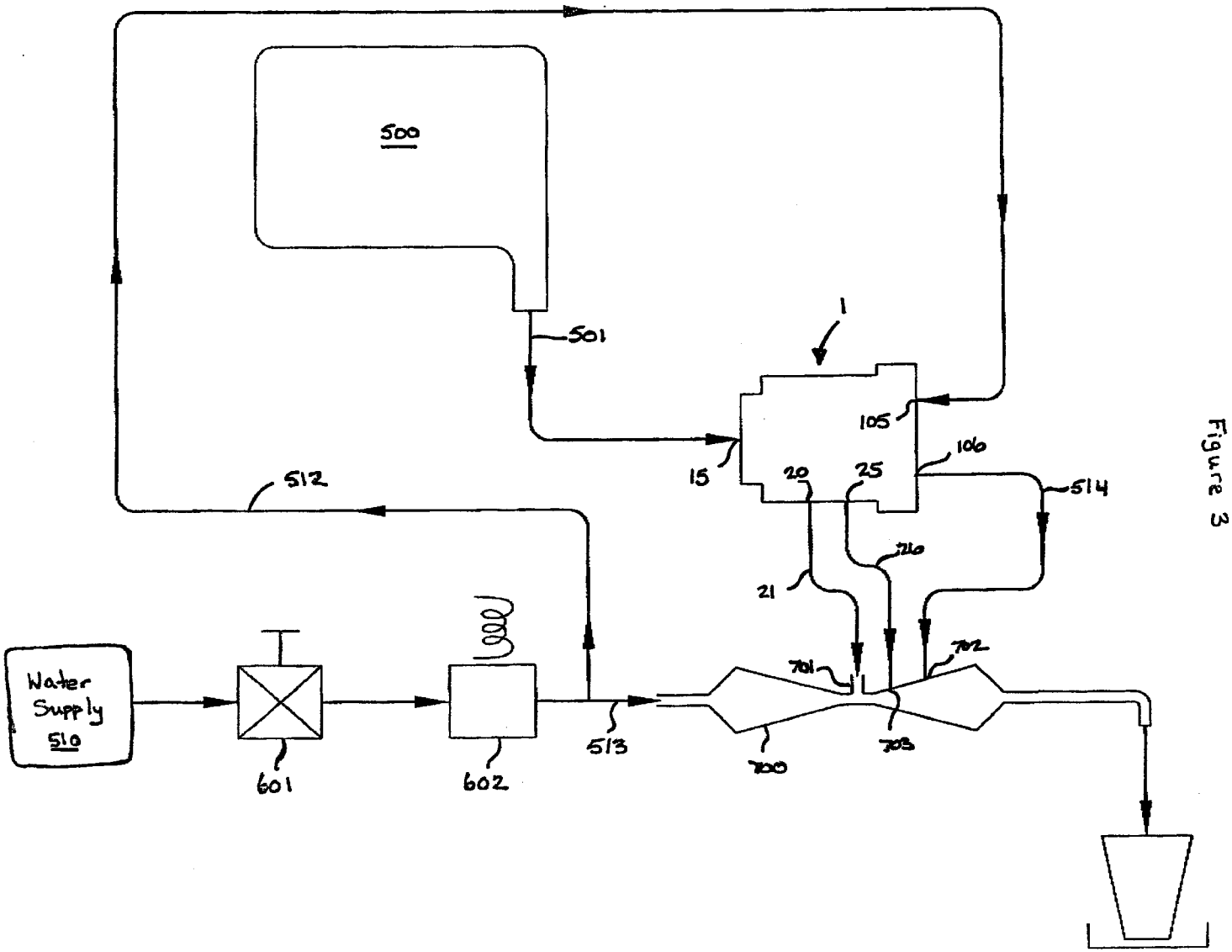
FIG. 3 is a schematic view of a fluid dispensing system according to the present invention and incorporating the valve of FIGS. 1 and 2.

Valve 1 is positioned between the source of the fluid concentrate and the point at which the concentrate is introduced to the diluent so as to prohibit the inadvertent flow of concentrate into the fluid supply line when diluent flow through the line is terminated. As shown more particularly in the schematic view of FIG. 3, the fluid dispensing system of the present invention comprises a container of concentrate (e.g., flavoring syrup) 500 which supplies concentrate to inlet port 15 of valve 1 through conduit 501. Likewise, a diluent (e.g., water) supply 510 is provided for dispensing the diluent that will mix with dispensed concentrate. The supply of diluent is preferably regulated through pressure regulator 601 and solenoid valve 602, as is well known in the art. From solenoid valve 602, the diluent supply separates into a first branch 512 and a second branch 513. First branch 512 comprises a conduit which directs diluent from solenoid valve 602 to inlet port 105 of valve 1. The flow of diluent through inlet port 105 applies a positive pressure actuation force to positive pressure actuation zone 50 of valve 1, in turn opening valve 1 so as to allow concentrate to flow from supply 500. Likewise, second branch 513 comprises a conduit which directs diluent from solenoid valve 602 to the inlet of a venturi or jet pump 700.

Venturi 700 more particularly comprises a differential pressure injector having an internal diameter which constricts from the injector inlet to an injection chamber. The injection chamber is located at the intersection of the injector inlet, the injector outlet, and a suction port 701. As the water enters the injector inlet, it constricts toward the injection chamber and changes into a high velocity jet stream. The increase in velocity through the injection chamber, as a result of the differential pressure between the inlet and outlet sides of the injector, results in a decrease in pressure in the injection chamber. This pressure drop enables an additive material, such as a concentrate used in the fluid dispensing system of the present invention, to be drawn through the suction port and mixed with the motive diluent stream. As the jet stream is diffused toward the injector outlet, its velocity is reduced and it is reconverted into pressure energy.

Thus, as diluent is supplied to the inlet of venturi 700, its flow through venturi 700 draws the concentrate from outlet port 20 of valve 1, through conduit 21 to suction port 701, where the concentrate is introduced into and mixed with the stream of diluent, so long as valve 1 is actuated so as to enable concentrate to flow.

As explained above, diluent may be directed to positive pressure actuation zone 50 of valve 1 so as to open the valve and allow concentrate to flow therethrough. In order to draw off the diluent supplied to positive pressure actuation zone 50, a diluent return line 514 is provided which directs diluent from outlet port 106 in positive pressure actuation zone 50 to another suction port 702 positioned adjacent the injector outlet of venturi 700, such that the diluent returned through diluent return line 514 reenters the flow stream where the flow is near atmospheric pressure.

Further, as explained above, vacuum may be applied to negative pressure actuation zone 40 in order to open valve 1 and allow concentrate to flow therethrough. In order to apply such a vacuum to negative pressure actuation zone 40, yet another suction port 703 is provided in venturi 700, suction port 703 being positioned in close proximity to suction port 701. When diluent flows through venturi 700 and creates a decrease in pressure in the injection chamber, such decrease in pressure applies a vacuum through conduit 26 to negative pressure actuation zone 40 of valve 1 (as described in detail above), in turn unseating valve head 205 from valve seat 16 and allowing concentrate to flow through outlet port 20. Alternately, a T-joint fluid coupling may be located at suction port 701, each branch of the T-joint receiving one of conduits 21 and 26. With such a fluid coupling, the single suction port 701 provides both the vacuum used to draw concentrate into the diluent stream, and the vacuum supplied to negative pressure actuation zone 40 to open valve 1.

Figure 4:
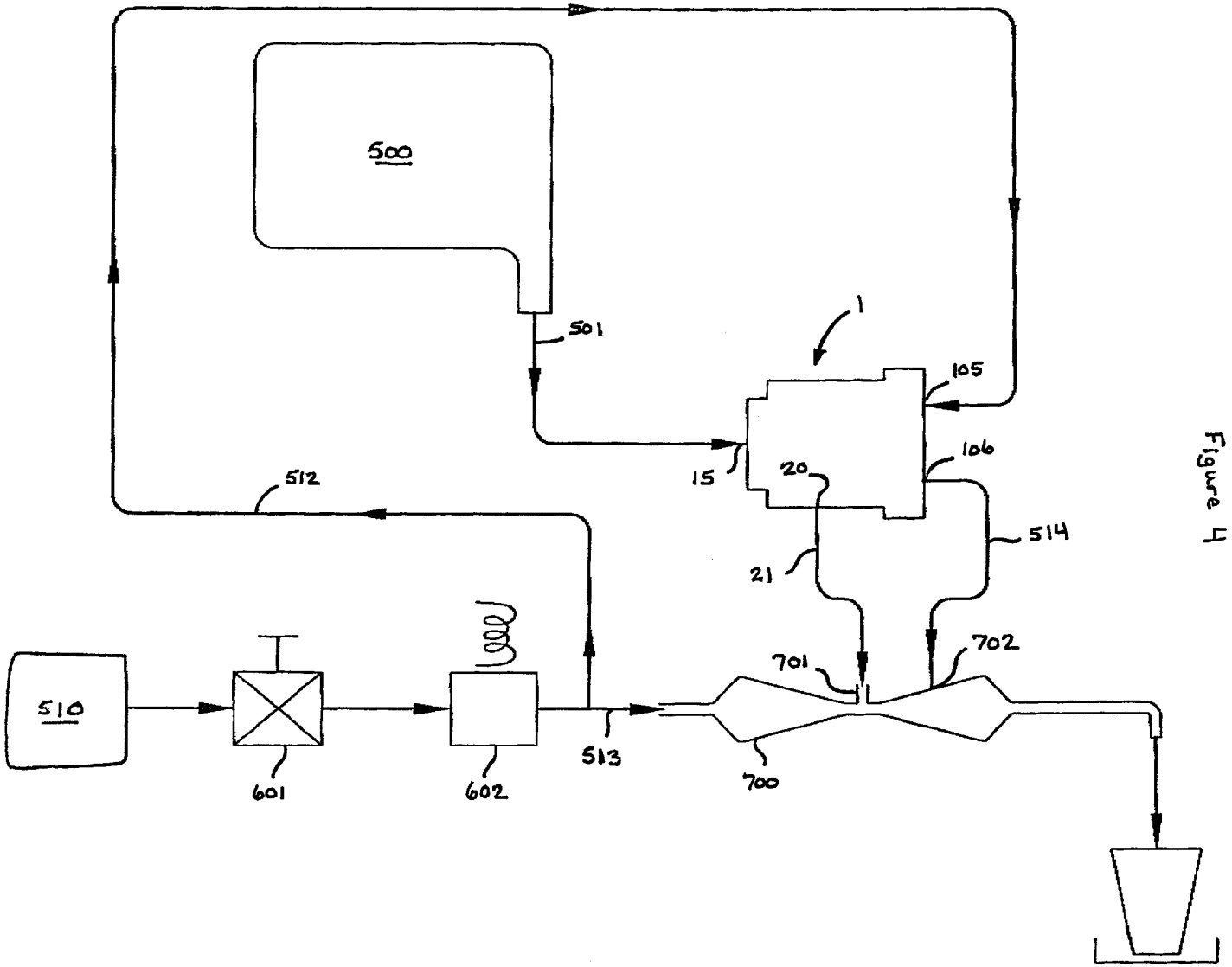
FIG. 4 is a schematic view of a first alternate embodiment of a fluid dispensing system according to the present invention.
Figure 5:
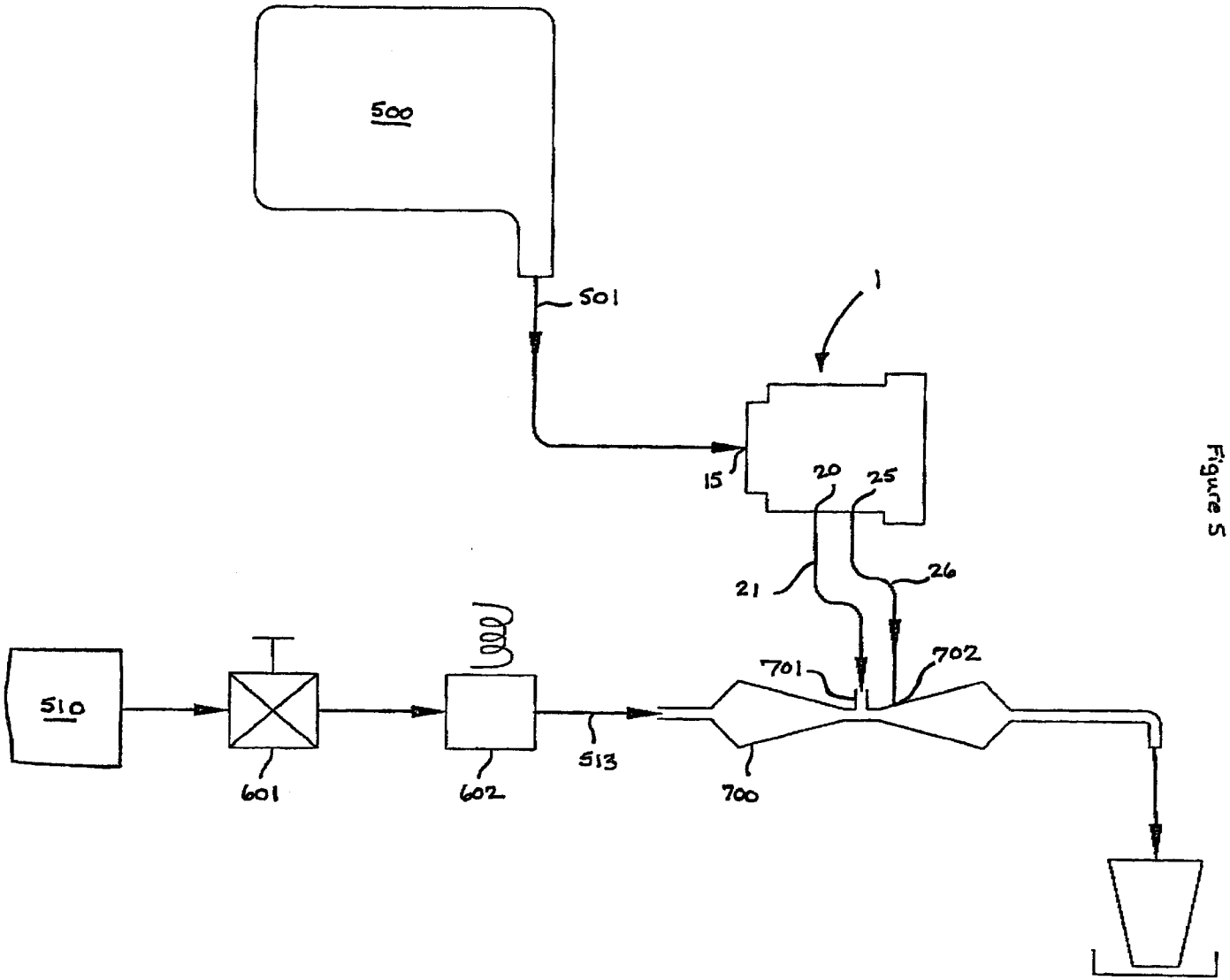
FIG. 5 is a schematic view of a second alternate embodiment of a fluid dispensing system according to the present invention.

The system set forth above particularly describes actuation of valve 1 through the simultaneous application of both positive fluid pressure to positive pressure actuation zone 50 and negative pressure to negative pressure actuation zone 40, both of which forces compliment one another to unseat valve head 205 from valve seat 16 to in turn enable concentrate to flow through valve 1. However, alternate embodiments of the fluid dispensing system of the present invention provide for a single one of positive pressure or negative pressure to actuate valve 1 as set forth above, such that the fluid handling system for the alternate pressure application means may be removed from the system of the present invention while maintaining the system's functionality and compact configuration. For example, the alternate embodiment of the present invention shown in FIG. 4 depicts the fluid handling system of FIG. 3 without vacuum conduit 26 and vacuum port 25 on valve 1, such that the sole actuating force for valve 1 is positive fluid pressure applied through conduit 512 to inlet port 105 of positive pressure actuation zone 50. Likewise, FIG. 5 depicts yet another alternate embodiment of the present invention in which fluid conduit 512, diluent return line 514, and inlet and outlet ports 105 and 106 of positive pressure actuation zone 50 of valve 1 are eliminated, such that the sole actuating force for valve 1 is vacuum pressure applied through conduit 26 to vacuum port 25 of negative pressure actuation zone 50.

Alternately, additional valves in fluid conduits 512 and 26 may be provided to enable the system to selectively operate valve 1 through either positive pressure applied to positive pressure actuation zone 50, negative pressure applied to negative pressure actuation zone 40, or the simultaneous application of both positive pressure and negative pressure in complimentary fashion, thus providing maximum flexibility for controlling the flow of a variety of fluids.

It should be noted that, while the system described herein is particularly designed to overcome the difficulties presented in controlling the flow of highly viscous fluids (e.g., juice, dairy, or isotonic concentrate), the system is equally efficient in regulating the flow of less viscous constituents, (e.g., flavoring syrups for soft drinks), and may also be used in any application requiring the mixing of multiple distinct fluids.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

I claim:

1. A fluid dispensing system for mixing at least a first and second fluid comprising:

a first flow path carrying said first fluid;

a second flow path carrying said second fluid;

a valve within said second flow path positioned downstream from a source of said second fluid, said valve comprising a valve plunger and a dispensing fluid flow path carrying said second fluid; and a mixer for combining said first and second fluids downstream of said valve;

wherein said first flow path is fluidly engaged with said valve to open said dispensing fluid flow path when fluid is carried through said first flow path, and wherein said first flow path applies a vacuum force to said valve plunger within said valve so as to move said plunger from a closed position in which flow through said second flow path is prevented, to an open position in which flow through said second flow path is enabled.

2. The fluid dispensing system of claim 1, wherein said first flow path is further configured to apply fluid pressure to said valve plunger within said valve so as to move said plunger from a closed position in which flow through said second flow path is prevented, to an open position in which flow through said second flow path is enabled.

3. The fluid dispensing system of claim 1, wherein said first flow path further directs said first fluid against said valve plunger within said valve so as to move said plunger from a closed position in which flow through said second flow path is prevented, to an open position in which flow through said second flow path is enabled.

4. The fluid dispensing system of claim 1, said valve further comprising an actuation fluid flow path isolated from fluid communication with said dispensing fluid flow path, said actuation fluid flow path being in fluid communication with said first flow path.

5. The fluid dispensing system of claim 1, said valve further comprising:

a valve body;

an intermediate wall within said valve body and defining within said valve body a flow chamber and an actuation chamber isolated from fluid communication with one another; and a dispensing fluid inlet port and a dispensing fluid outlet port, each enabling fluid communication between said second flow path and said flow chamber; wherein said valve plunger is slidably mounted within said intermediate wall, said valve plunger being movable from a closed position in which fluid communication between said dispensing fluid inlet port and said dispensing fluid outlet port is disabled, to an open position in which fluid communication between said dispensing fluid inlet port and said dispensing fluid outlet port is enabled.

6. The fluid dispensing system of claim 5, said valve plunger further being movable in response to the application of fluid pressure generated by said first fluid.

7. The fluid dispensing system of claim 5, further comprising a flexible diaphragm positioned within said actuation chamber and defining a vacuum pressure actuation zone and a positive pressure actuation zone isolated from fluid communication with one another.

8. The fluid dispensing system of claim 7, said valve further comprising:

an actuation fluid inlet port and an actuation fluid outlet port, each enabling fluid communication between said first flow path and said positive pressure actuation zone; and an actuation fluid vacuum port enabling fluid communication between said first flow path and said vacuum pressure actuation zone.

9. The fluid dispensing system of claim 1, said valve further comprising:

a valve body;

a dispensing fluid inlet port in said valve body and in fluid communication with said second flow path;

a dispensing fluid outlet port in said valve body and in fluid communication with said second flow path;

an actuation fluid inlet port in said valve body and in fluid communication with said first flow path;

an actuation fluid outlet port in said valve body and in fluid communication with said first flow path; and an actuation fluid vacuum port in said valve body and in fluid communication with said first flow path.

10. The fluid dispensing system of claim 9, said valve further comprising:

an intermediate wall within said valve body and defining within said valve body a flow chamber and an actuation chamber isolated from fluid communication with one another; wherein said valve plunger is slidably mounted within said intermediate wall, said valve plunger being movable from a closed position in which fluid communication between said dispensing fluid inlet port and said dispensing fluid outlet port is disabled, to an open position in which fluid communication between said dispensing fluid inlet port and said dispensing fluid outlet port is enabled.

11. The fluid dispensing system of claim 10, said valve plunger further comprising:

a first end having a valve head;

a second end; and a shaft extending between said first end and said second end and through said intermediate wall.

12. The fluid dispensing system of claim 11, said valve further comprising a valve seat within said flow chamber configured to mate with said valve head to prevent flow of said second fluid through said flow chamber.

13. The fluid dispensing system of claim 12, said valve further comprising a spring member biasing said valve head towards said valve seat.

14. The fluid dispensing system of claim 13, valve plunger further comprising a piston head attached to said second end, wherein said spring member is positioned between said intermediate wall and said piston head.

15. The fluid dispensing system of claim 10, said valve further comprising a flexible diaphragm positioned within said actuation chamber and defining a vacuum pressure actuation zone and a positive pressure actuation zone isolated from fluid communication with one another.

16. The fluid dispensing system of claim 15, wherein said actuation fluid inlet port and said actuation fluid outlet port are in fluid communication with said positive pressure actuation zone, and said actuation fluid vacuum port is in fluid communication with said vacuum pressure actuation zone.

17. A fluid dispensing system comprising:

a first flow path carrying a first fluid;

a second flow path carrying a second fluid; and a valve in fluid communication with said first and second flow paths, said valve comprising:

a valve body;

an intermediate wall within said valve body and defining within said valve body a flow chamber and an actuation chamber isolated from fluid communication with one another, said flow chamber defining a dispensing fluid flow path carrying said second fluid therethrough, and said actuation chamber being in fluid communication with said first flow path;

a flexible diaphragm positioned within said actuation chamber, said flexible diaphragm defining a vacuum pressure actuation zone and a positive pressure actuation zone isolated from fluid communication with one another;

a dispensing fluid inlet port and dispensing fluid outlet port, each enabling fluid communication between said second flow path and said flow chamber; and a valve plunger slidably mounted within said intermediate wall, said valve plunger being movable from a closed position in which fluid communication between said dispensing fluid inlet port and said dispensing fluid outlet port is disabled, to an open position in which fluid communication between said dispensing fluid inlet port and said dispensing fluid outlet port is enabled.

18. The fluid dispensing system of claim 17, said valve plunger further being movable in response to the application of fluid pressure generated by said first fluid.

19. The fluid dispensing system of claim 17, said valve further comprising:

an actuation fluid inlet port and an actuation fluid outlet port, each enabling fluid communication between said first flow path and said positive pressure actuation zone; and an actuation fluid vacuum port enabling fluid communication between said first flow path and said vacuum pressure actuation zone.

20. A fluid dispensing system comprising:

a first flow path carrying a first fluid;

a second flow path carrying a second fluid; and a valve in fluid communication with said first and second flow paths, said valve further comprising:

a valve body;

a dispensing fluid inlet port in said valve body and in fluid communication with said second flow path;

a dispensing fluid outlet port in said valve body and in fluid communication with said second flow path;

an actuation fluid inlet port in said valve body and in fluid communication with said first flow path;

an actuation fluid outlet port in said valve body and in fluid communication with said first flow path; and an actuation fluid vacuum port in said valve body and in fluid communication with said first flow path.

21. The fluid dispensing system of claim 20, said valve further comprising:

an intermediate wall within said valve body and defining within said valve body a flow chamber and an actuation chamber isolated from fluid communication with one another; and a valve plunger slidably mounted within said intermediate wall, said valve plunger being movable from a closed position in which fluid communication between said dispensing fluid inlet port and said dispensing fluid outlet port is disabled, to an open position in which fluid communication between said dispensing fluid inlet port and said dispensing fluid outlet port is enabled.

22. The fluid dispensing system of claim 21, said valve plunger further comprising:

a first end having a valve head;

a second end; and a shaft extending between said first end and said second end and through said intermediate wall.

23. The fluid dispensing system of claim 22, said valve further comprising a valve seat within said flow chamber configured to mate with said valve head to prevent flow of said second fluid through said flow chamber.

24. The fluid dispensing system of claim 23, said valve further comprising a spring member biasing said valve head towards said valve seat.

25. The fluid dispensing system of claim 24, said valve plunger further comprising a piston head attached to said second end, wherein said spring member is positioned between said intermediate wall and said piston head.

26. The fluid dispensing system of claim 21, said valve further comprising a flexible diaphragm positioned within said actuation chamber and defining a vacuum pressure actuation zone and a positive pressure actuation zone isolated from fluid communication with one another.

27. The fluid dispensing system of claim 26, wherein said actuation fluid inlet port and said actuation fluid outlet port are in fluid communication with said positive pressure actuation zone, and said actuation fluid vacuum port is in fluid communication with said vacuum pressure actuation zone.

* * * * *